US008292032B2

(12) United States Patent
Knaak

(10) Patent No.: US 8,292,032 B2
(45) Date of Patent: Oct. 23, 2012

(54) PLATFORM LIFT

(76) Inventor: Theodore Fred Knaak, Orlando, FL (US)

( * ) Notice: Subject to any disclaimer, the term of this patent is extended or adjusted under 35 U.S.C. 154(b) by 389 days.

(21) Appl. No.: 12/395,294

(22) Filed: Feb. 27, 2009

(65) Prior Publication Data

US 2010/0219018 A1 Sep. 2, 2010

(51) Int. Cl.
*E04G 3/28* (2006.01)
*E06C 5/06* (2006.01)

(52) U.S. Cl. ..... 182/141; 182/63.1; 182/69.4; 182/69.6

(58) Field of Classification Search ..... 182/141, 182/63.1, 69.4, 69.6; 187/232, 240, 244, 187/210, 267; 254/7 C, 98, 102
See application file for complete search history.

(56) References Cited

U.S. PATENT DOCUMENTS

| | | | | | |
|---|---|---|---|---|---|
| 2,277,505 | A | * | 3/1942 | Barker et al. | 73/382 R |
| 3,283,850 | A | | 11/1966 | Jones et al. | |
| 3,472,337 | A | | 10/1969 | Atchey | |
| 3,529,694 | A | | 9/1970 | Atchey | |
| 3,638,757 | A | * | 2/1972 | Sampson | 182/69.6 |
| 3,664,459 | A | | 5/1972 | Stephens et al. | |
| 3,716,923 | A | * | 2/1973 | Bazhaw | 33/264 |
| 3,724,697 | A | * | 4/1973 | Arvidsson | 414/495 |
| 3,768,591 | A | | 10/1973 | Stucky et al. | |
| 3,826,334 | A | | 7/1974 | Spillman | |
| 3,882,964 | A | | 5/1975 | Schellenberg | |
| 4,050,707 | A | * | 9/1977 | Glumac | 280/43.23 |
| 4,060,145 | A | * | 11/1977 | Kingman et al. | 280/789 |
| 4,103,757 | A | * | 8/1978 | McVaugh | 182/2.1 |
| 4,593,474 | A | * | 6/1986 | Mayhew | 33/264 |
| 4,600,348 | A | * | 7/1986 | Pettit | 414/11 |
| 4,752,102 | A | * | 6/1988 | Rasmussen | 297/344.2 |
| 4,919,234 | A | * | 4/1990 | Pearson et al. | 187/213 |
| 5,297,653 | A | | 3/1994 | Wurtz et al. | |
| 5,322,403 | A | * | 6/1994 | Herde | 414/11 |
| 5,609,332 | A | * | 3/1997 | Hassell | 269/16 |
| 6,155,770 | A | * | 12/2000 | Warhurst | 414/498 |
| 6,349,793 | B1 | * | 2/2002 | Kincaid | 182/69.4 |
| 6,626,479 | B1 | * | 9/2003 | Skoug | 296/37.6 |
| 6,761,248 | B1 | | 7/2004 | Harbison | |
| 7,004,286 | B2 | | 2/2006 | Fredette | |
| 7,913,629 | B2 | * | 3/2011 | Gordon | 108/51.3 |
| 2011/0232537 | A1 | * | 9/2011 | Gordon | 108/50.11 |

* cited by examiner

*Primary Examiner* — Alvin Chin Shue
*Assistant Examiner* — Jaime F Cardenas-Garcia
(74) *Attorney, Agent, or Firm* — Foley & Lardner LLP

(57) ABSTRACT

A platform lift for use with a vehicle includes a platform assembly having a plurality of support legs, and a lift mechanism having a support portion moveable between at least a first position and a second position. The platform assembly may be configured to be supported by the support portion when the support portion is in the first position, and further configured to be supported by the support legs substantially independent from the lift mechanism and the vehicle when the support portion is in the second position.

13 Claims, 8 Drawing Sheets

PLATFORM LIFT

BACKGROUND

This application relates generally to the field of platform lifts, and more specifically, to a platform lift that may be used to isolate one or more devices such as a surveying device from a vehicle.

Conventional platform lifts have several disadvantages in terms of efficiency during use and operator safety, particularly when utilizing platform lifts in combination with a vehicle in areas such as highways, etc, where vehicle traffic may pose various problems to users of platform lifts.

DETAILED DESCRIPTION OF EXEMPLARY EMBODIMENTS

Figure 1:
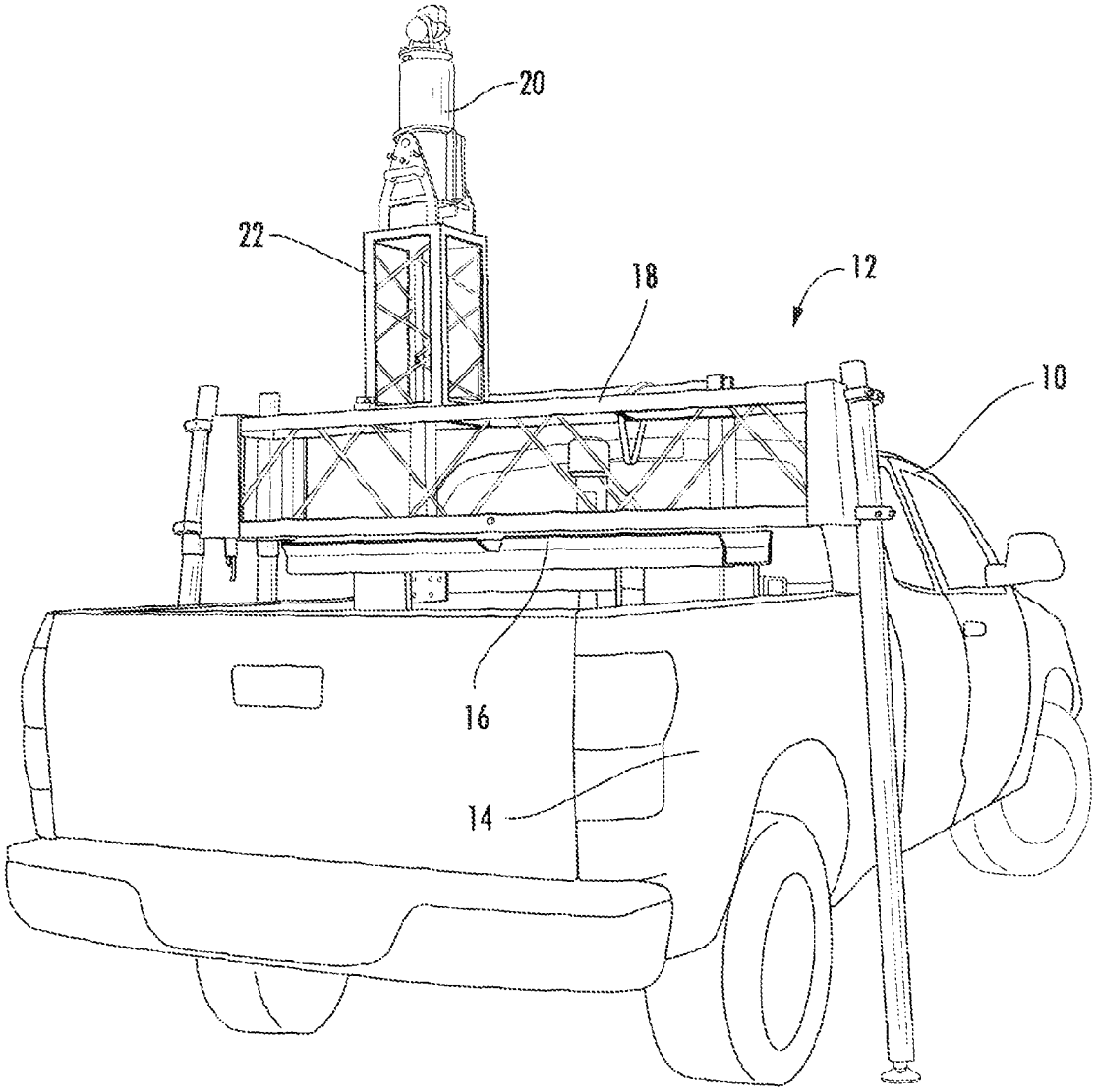
FIG. 1 is a rear perspective view of a vehicle and a platform lift according to an exemplary embodiment.

Referring to FIG. 1, a vehicle 10 (a truck, maintenance vehicle, service vehicle, etc.), upon which a platform lift 12 (a lift assembly, system, or device, a surveying system, etc.) is mounted, is shown according to an exemplary embodiment. As shown in FIG. 1, vehicle 10 may be a truck having a bed 14, and platform lift 12 may be provided within or upon bed 14. Platform lift 12 may include a lift mechanism 16 (e.g., a lifting device, a lift, etc.) and a platform assembly or support structure 18 (e.g., a bridge assembly, support assembly, etc.). Support structure 18 may further be configured to support one or more devices 20, such as a surveying device (e.g., a laser measuring device such as a light detection and ranging (LIDAR) scanner, etc.), and may include one or more secondary supports 22 that assist in providing additional elevation for proper positioning of device 20. Generally, lift mechanism 16 is configured to be mounted or otherwise coupled to bed 14, and to be operable to provide support structure 18, and in turn device 20, at varying heights as discussed in greater detail below. However, it should be noted that according to various alternative embodiments, platform lift 12 may be provided in a variety of locations (e.g., front, rear, roof, etc.) on a wide variety of vehicles.

Figure 4:
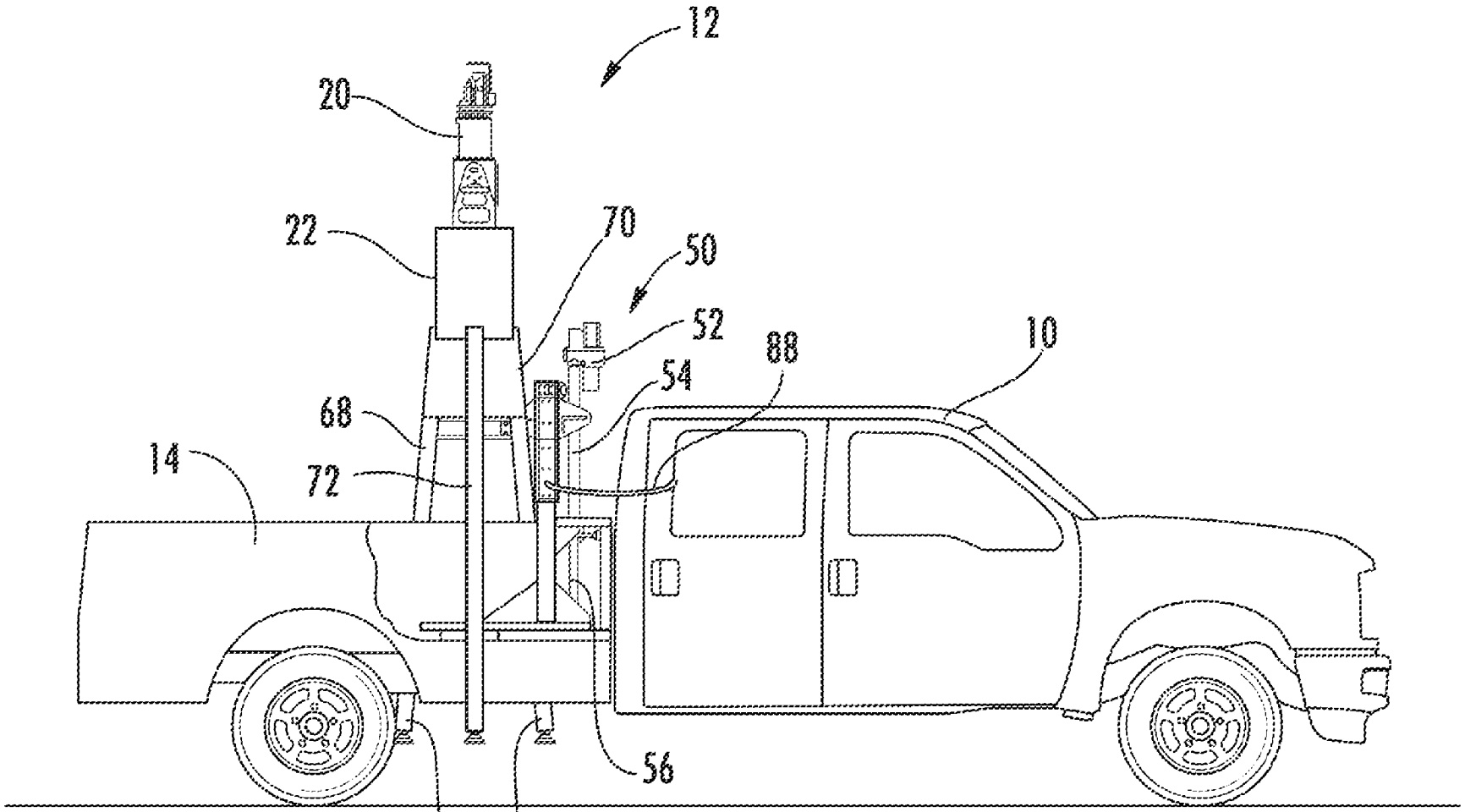
FIG. 4 is a side view of the vehicle and platform lift of FIG. 1 in the first configuration with a portion of the vehicle cut away according to an exemplary embodiment.
Figure 5:
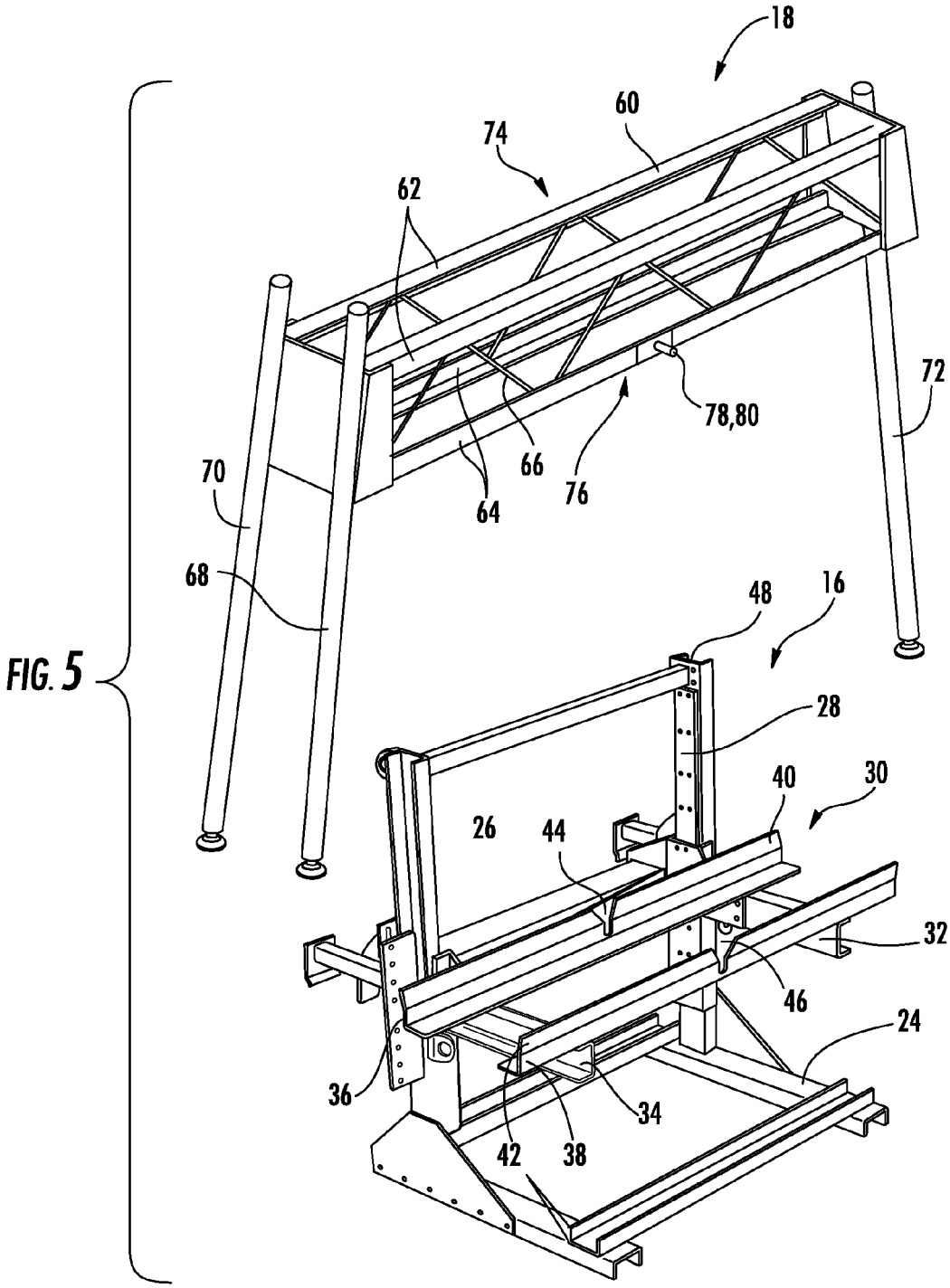
FIG. 5 is an exploded view of the platform lift of FIG. 1 according to an exemplary embodiment.

Referring to FIG. 5, lift mechanism 16 and support structure 18 are shown in greater detail according to an exemplary embodiment. For clarity, lift mechanism 16 is shown in FIG. 5 without a corresponding drive mechanism (shown, for example, in FIGS. 2 and 4 as drive mechanism 50). As shown in FIG. 5, lift mechanism 16 may include a base 24, to which a pair of generally upright rails 26, 28 are coupled. Base 24 may include features to facilitate mounting of lift mechanism

16 to a vehicle such as vehicle 10 (e.g., fastening features, holes, parts formed in a complimentary fashion to corresponding components on a vehicle, etc.). A support assembly 30 (e.g., a support portion, upper portion, etc.) may move along rails 26, 28 between a variety of positions (e.g., varying vertical positions) between base 24 and a top support 48. Top support 48 may act to prevent over-travel of support assembly 30 in an upward direction, in addition to assisting to maintain rails 26, 28 in the proper positions (e.g., in a generally parallel orientation to one another).

According to an exemplary embodiment, support assembly 30 may include a pair of support arms 32, 34 that extend in a generally perpendicular fashion (e.g., in a generally horizontal fashion) relative to rails 26, 28. Support arms 32, 34 may be moveably coupled (e.g., slidably coupled, adjustably coupled, etc.) to rails 26, 28 via any conventional means to provide for movement of support assembly 30 along rails 26, 28 (e.g., via the use of complimentary-shaped rails, channels, slots, grooves, rollers, guides, etc., a drawer-slide-type mechanism, etc.). In some embodiments, support arms 32, 34 may be adjustable longitudinally to adjust the length of support arms 32, 34 that extend to one side or the other of rails 26, 28 (e.g., in a horizontal direction).

According to an exemplary embodiment, support assembly 30 may further include a pair of guide rails 36, 38. As shown in FIG. 5, guide rails 36, 38 may span between support arms 32, 34 in a transverse fashion relative to support arms 32, 34 and in a generally parallel fashion relative to one another. According to an exemplary embodiment, guide rails 36, 38 may be provided with flanges 40, 42, (e.g., bent portions, extensions, etc.) that flair outward from each other to facilitate mounting of support structure 18 to lift mechanism 16, as discussed in further detail below. According to yet further embodiments, guide rails 36, 38 may include one or more guide slots 44, 46, that may be configured to receive corresponding projections 78, 80 provided on support structure 18, as also discussed in further detail below.

Referring further to FIG. 5, support structure 18 may include a platform 60 (e.g., a bridge, etc.) and a number of supports, or legs 68, 70, 72 (e.g., support legs or members, extensions, etc.). According to one embodiment, three legs 68, 70, 72 are provided as part of support structure 18. The use of three legs provides a stable base for support structure 18 (particularly with uneven ground often encountered when performing activities such as surveying, etc.) and avoids potential tipping and other movement during measurement of various parameters that may otherwise cause inaccuracies in data (e.g., with the use of two or four legs). According to alternative embodiments, more than three legs may be used (e.g., four legs, etc.).

Platform 60 may include one or more rails 62, 64 that form upper and lower portions of platform 60. A support structure, or trusses, 66 may provide structural support and stability to platform 60, and may join an upper portion 74 and a lower portion 76 of support structure 18. Upper portion 74 may have a generally planar portion or surface configured to support secondary support 22 and/or device 20. Legs 68, 70, 72 may be coupled to platform 60 in a fixed, nonmoveable manner (e.g., permanently fixed, unmoveable by human operators, locked, etc.) in one embodiment. For example, legs 68, 70, 72 may be coupled to platform 60 via a welding operation, mechanical fasteners such as threaded fasteners, rivets, etc., or legs 68, 70, 72 may be provided as an integrally molded or formed portion of platform 60. Further, legs 68, 70, 72 may be provided with fixed lengths (e.g., such that the length of the legs is not adjustable). Providing legs such as legs 68, 70, 72 having fixed lengths that are secured to platform 60 in a nonmoveable manner further increases the stability of support structure 18, and reduces the amount of movement that may be caused by uneven terrain, wind, passing vehicles, etc.

Figure 3:
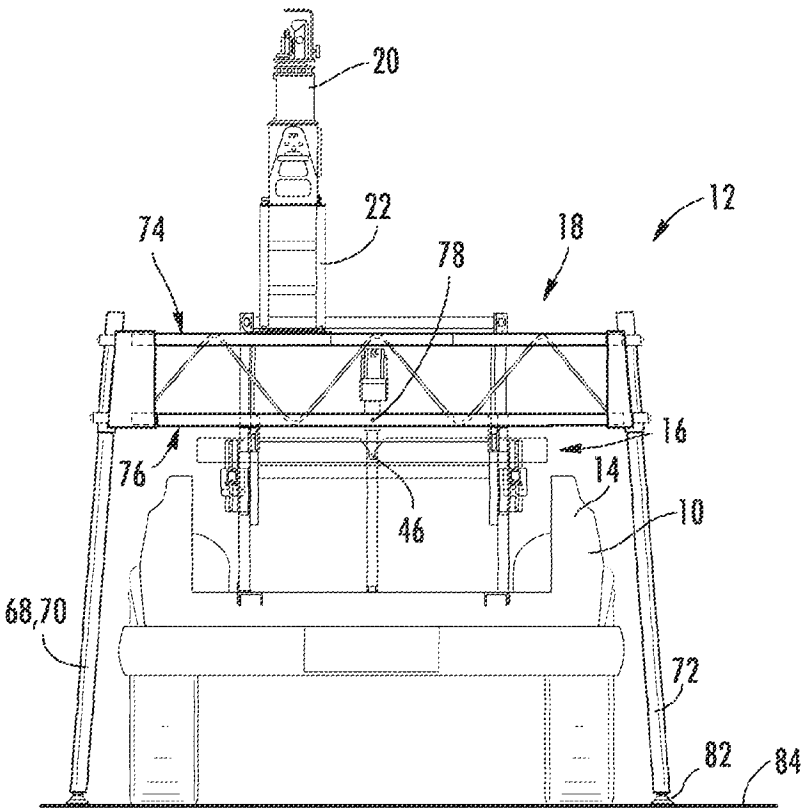
FIG. 3 is a rear view of the vehicle and platform lift of FIG. 2 in a second configuration according to an exemplary embodiment.
Figure 2:
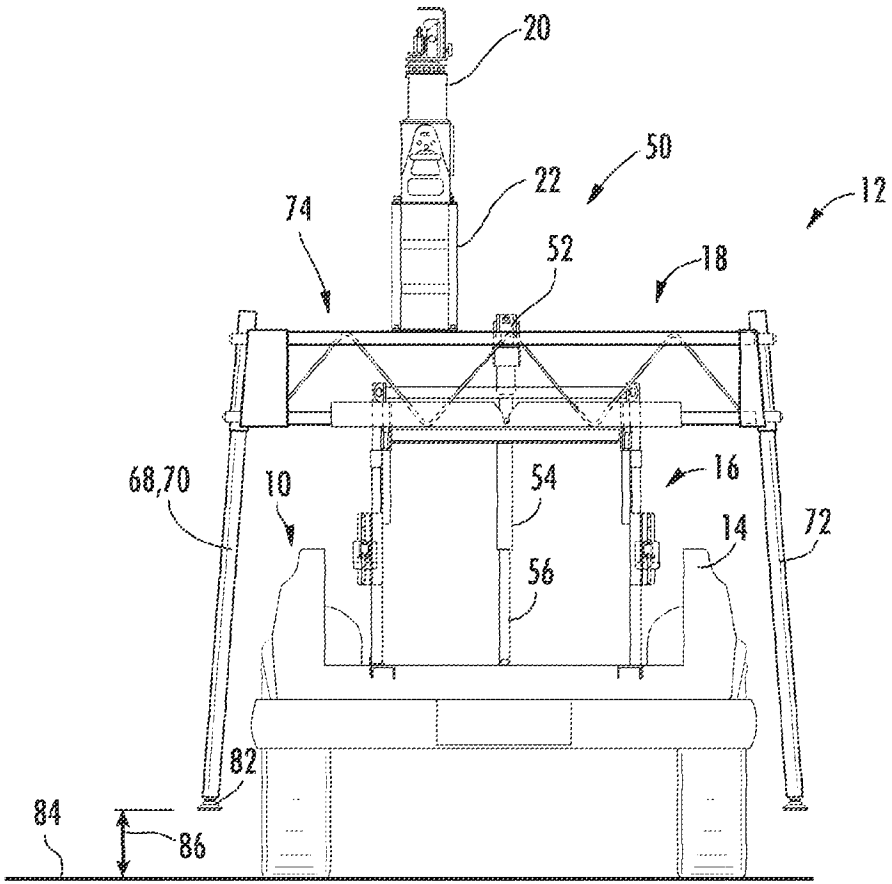
FIG. 2 is a rear view of a vehicle and platform lift in a first configuration according to an exemplary embodiment.

Legs 68, 70, 72 may further be provided with feet 82 that may be configured to rotate, swivel, pivot, or otherwise provide an adjustability between legs 68, 70, 72 and a surface such as a ground surface 84 (see FIGS. 2-4). According to various alternative embodiments, legs 68, 70, 72 may be provided as separate, rigid structures, or alternatively, may be integrally molded as part of support structure 18.

According to one embodiment, support structure 18 is configured to be supported by lift mechanism 16. Lower portion 76 of support structure 18 may be received within guide rails 36, 38 of lift mechanism 16. In order to help ensure proper engagement of lift mechanism 16 and support structure 18, flanges 40, 42 provided on guide rails 36, 38 may guide lower portion 76 into proper alignment with guide rails 36, 38. Further, projections 78, 80 on lower portion 76 may be positioned to be received within slots 44, 46 on guide rails 36, 38, further helping to secure support structure 18 in position. During operation of vehicle 10, and while support structure 18 is supported by lift mechanism 16, lower portion 76 and guide rails 36, 38 interface to provide a secure mounting for support structure 18. For example, guide rails 36, 38 prevent forward/backward motion of support structure 18 relative to lift mechanism 16. Similarly, projections 78, 80 and slots 44, 46 prevent sideways (e.g., left to right as shown in FIGS. 2-3) movement of support structure 18 relative to lift mechanism 16. Various other features may be provided on lift mechanism 16, support structure 18, or other components of platform lift 12 in order to provide for secure engagement between lift mechanism 16 and support structure 18.

Referring to FIG. 4, lift mechanism 16 may further include a drive mechanism 50 (e.g., an actuator, position controlling device, etc.). Drive mechanism 50 may be configured to be moveable between a variety of positions (or, alternatively, move support assembly 30 between a variety of positions), and may be coupled to lift mechanism 16 in order to provide support assembly 30 at varying heights. According to one embodiment, drive mechanism 50 includes a motor 52 that provides rotational movement (e.g., via a screw gear, etc.) that causes a first shaft 54 to move relative to a second shaft 56 (e.g., in a vertical direction). According to an exemplary embodiment, first shaft 54 may be coupled to support assembly 30, and second shaft 56 may be coupled to base 24, such that movement of first shaft 54 along second shaft 56 causes movement of support assembly 30 relative to base 24 (and, therefore, vehicle 10).

While as shown in FIG. 4 drive mechanism 50 includes motor 52 that may cooperate with a screw gear to cause movement of support assembly 30, according to various alternative embodiments, other types of drive mechanisms and drive mechanism components may be used. For example, as discussed in greater detail with respect to FIG. 6, a scissors-type lift may be used in conjunction with drive mechanism 50 or another type of drive mechanism or actuator (e.g., a hydraulic, pneumatic, etc., or other type of actuator or position control device) to provide the desired movement of support assembly 30.

Referring now to FIGS. 2-3, platform lift 12 is shown at differing positions relative to vehicle 10. For example, as shown in FIG. 2, platform lift 12 is shown in a first configuration, position, or orientation (e.g., a travelling, stowed, or non-use position) according to an exemplary embodiment. As shown in FIG. 2, lift mechanism 16 is in a raised position (e.g., a first position), such that support structure 18 is supported by lift mechanism 16 and legs 68, 70, 72 are raised a distance 86 off of ground surface 84. According to one embodiment, lift mechanism 16 may be configured to raise upper portion 74 to a distance of approximately 94.25 inches (e.g., at least 80 inches, at least 90 inches, no more than 100 inches, etc.) above ground surface 84 (which distance may vary according to vehicle configurations, ground surface irregularities, etc.) such that feet 82 are raised approximately 12 inches (e.g., at least 8 inches, at least 10 inches, no more than 14 inches, no more than 20 inches, etc.) above ground surface 84 (e.g., to provide proper clearance for operation of vehicle 10).

While platform lift 12 is in the configuration shown in FIG. 2, vehicle 10 may be operated so that device 20 may be moved from a first location to a second location, for example, during the taking of various surveying measurements from various locations. During such operation, support structure 18 may be securely supported by lift mechanism 16 and sufficient clearance may be provided between legs 68, 70, 72 and ground surface 84 such that vehicle 10 may be moved efficiently between locations. Upon reaching a desired location, lift mechanism 16 may be lowered to a second position, as shown in FIG. 3.

Referring to FIG. 3, platform lift 12 is shown in a second configuration, position, or orientation (e.g., a measurement-taking, lowered, or usage position) according to an exemplary embodiment. As shown in FIG. 2, lift mechanism 16 is in a lowered position (e.g., a second position), such that support structure 18 is not supported by lift mechanism 16, but rather is structurally separated from lift mechanism 16 and supported on ground surface 84 by legs 68, 70, 72. According to one embodiment, lift mechanism 16 may be configured to lower support assembly 30 to separate from lower portion 76 of support structure 18 so that upper portion 74 of support structure 18 is a distance of approximately 82.25 inches (e.g., at least 70 inches, at least 80 inches, no more than 100 inches, etc.) above ground surface 84 (which distance may vary according to vehicle configurations, ground surface irregularities, etc.) such that feet 82 rest upon ground surface 84 (e.g., to provide proper support for operation of device 20). In this position, platform lift 12 is essentially a free-standing structure relative to vehicle 10 (except, possibly, for any required control or power cables, wires, etc., which may be configured so to not transmit any undesired forces between the vehicle and the platform lift).

According to an exemplary embodiment, platform lift 12 may be configured to be operable from a passenger compartment, or cab, of vehicle 10 (e.g., such that a driver and/or passenger of vehicle 10 may operate platform lift and/or device 20 from within vehicle 10). For example, a cable or wire 88 (see FIG. 4) may provide control signals and/or power to platform lift 12 and/or device 20 from a control unit within the cab of vehicle 10. Alternatively, platform lift 12 and/or device 20 may be wirelessly controlled from the cab of vehicle 10. Providing remote control features for platform lift 12 enables personnel such as surveying personnel to operate platform lift 12 (and, in the case of remote controllable devices, device 20), from within vehicle 10 and at various different locations without having to leave the vehicle. This provides many advantages over more conventional systems, where personnel may be required to leave a vehicle to properly secure/unsecure measurement equipment, by increasing operator safety (e.g., in the case of survey measurements taken along high-traffic roadways, etc.) and by decreasing the amount of time it takes to take individual measurements (e.g., by avoiding having to leave the vehicle at each location).

Further, platform lift 12 may support device 22 at a height that avoids problems with traffic, etc., and may provide an improved angle for taking measurements. Further yet, while platform lift 12 has been generally shown as providing vertical adjustment capabilities, in various alternative embodiments, platform lift 12 may further provide horizontal or other (e.g., rotational, etc.) adjustment capabilities. For example, one or more actuators (e.g., a conveyor belt, slide mechanism, etc.) may be provided in connection with platform lift 12 and be configured to provide horizontal movement or adjustment features to at least a portion of support assembly 30 or other portions of platform lift 12.

During operation of platform lift 12, an operator of vehicle 10, with support structure 18 in a raised position, may drive to a first location. The operator may (e.g., remotely) lower lift mechanism 16 until legs 68, 70, 72 engage ground surface 84, and continue to lower lift mechanism 16 until support structure 18 is free-standing (e.g., such that platform 60 is no longer structurally engaged with lift mechanism 16 or vehicle 10). FIG. 3 illustrates an exemplary embodiment of such a configuration. The operator may then take any desired measurements via device 20 (which may be remotely operable), such as any of a number of surveying-related measurements.

After taking any desired measurements at the first location, the operator may raise lift mechanism 16 to engage support structure 18, and continue to raise lift mechanism 16 to raise legs 60, 70, 72 off of ground surface 84. FIG. 2 illustrates an exemplary embodiment of such a configuration. The operator may then drive the vehicle to a second location where additional measurements may be taken in a similar manner. This process may be repeated as required.

Figure 6:
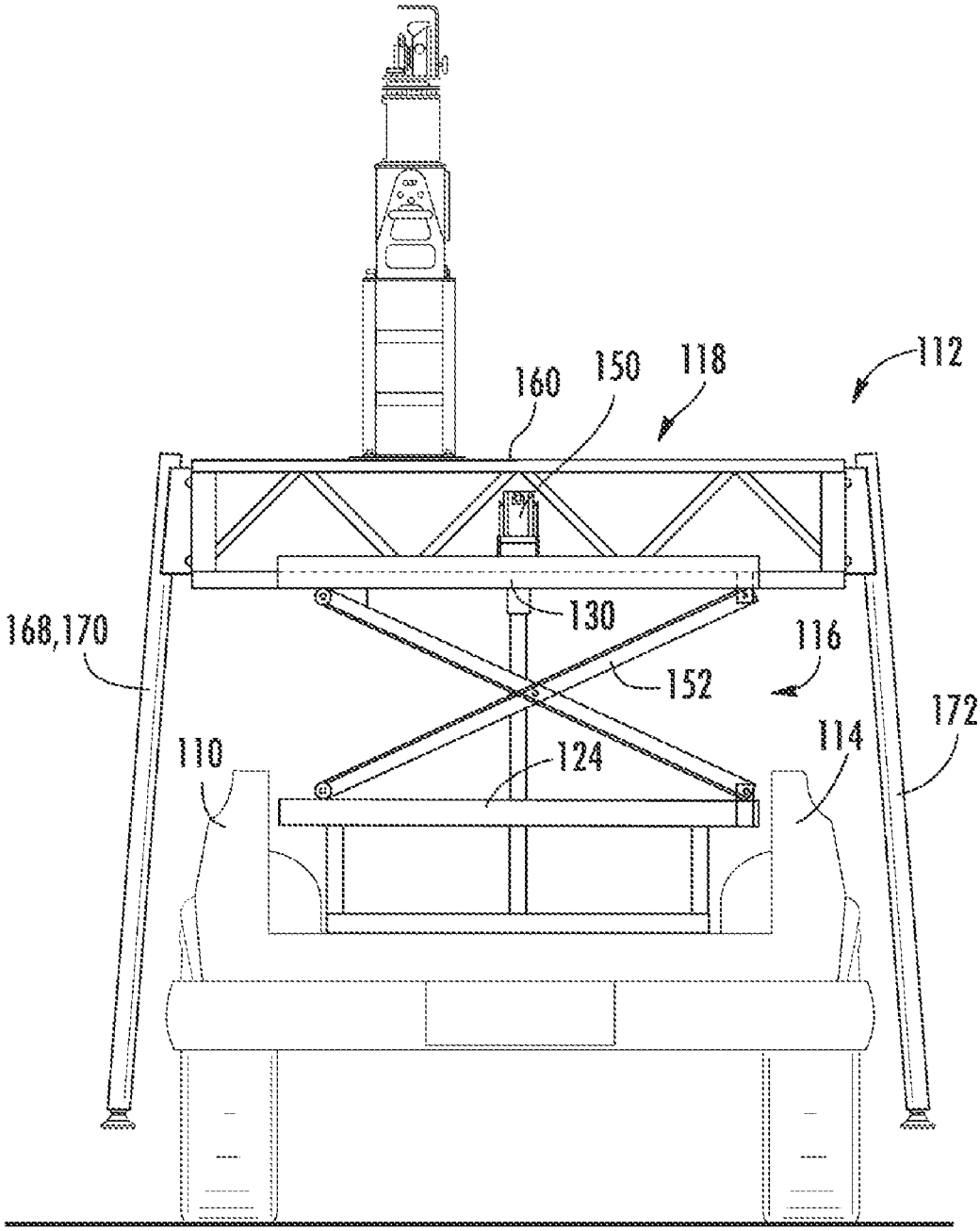
FIG. 6 is a rear view of a vehicle and platform lift according to another exemplary embodiment.

Referring now to FIG. 6, a platform lift 112 is shown according to an alternative embodiment. Platform lift 112 may be similar to platform lift 12 shown in FIGS. 1-5, and may include a lift mechanism 116 and a support structure 118. Lift mechanism 116 may be provided within a bed 114 (e.g., recessed within the bed, etc.) of a vehicle 110. Support structure 118 may include a platform 160 coupled to legs 168, 170, 172. According to an exemplary embodiment, lift mechanism 116 includes a scissors lift 152 that provides for varying heights of lift mechanism 116 via scissors action of scissors lift 152 and a drive mechanism 150. A support assembly 130 may be configured to engage support structure 118, and a base 124 may couple lift mechanism 116 to bed 114 of vehicle 110. Drive mechanism 150 and scissors lift 152 may be provided as an alternative means of controlling a lift mechanism to drive mechanism 50 and support assembly 30 shown, for example, in FIG. 4. As discussed above, other means of controlling the movement of lift mechanism 116 may be used according to various other embodiments (e.g., hydraulic, electric, pneumatic, etc.). Platform lift 112 may otherwise operate in generally the same fashion as platform lift 12.

Figure 7:
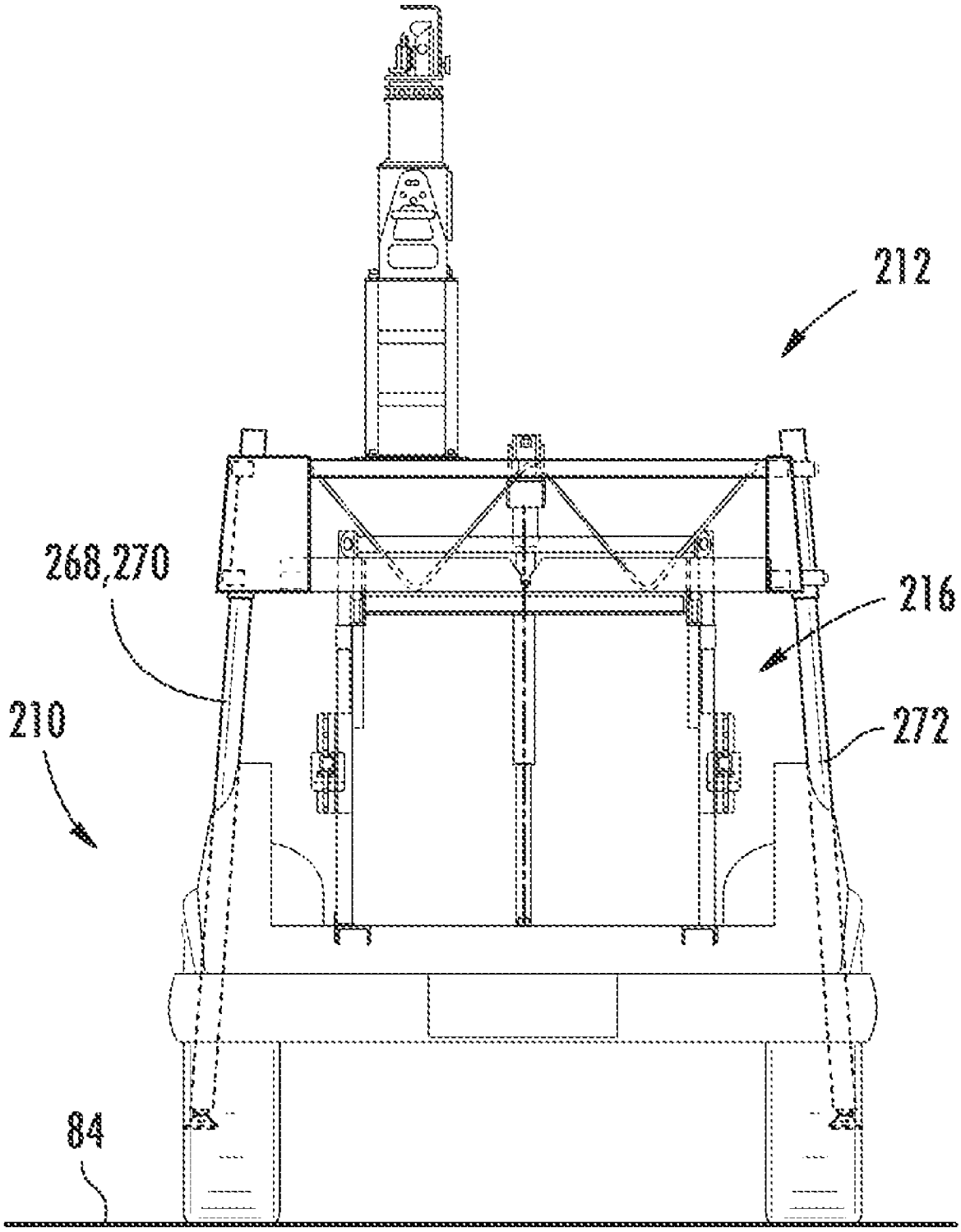
FIG. 7 is a rear view of a vehicle and platform lift according to another exemplary embodiment.
Figure 8:
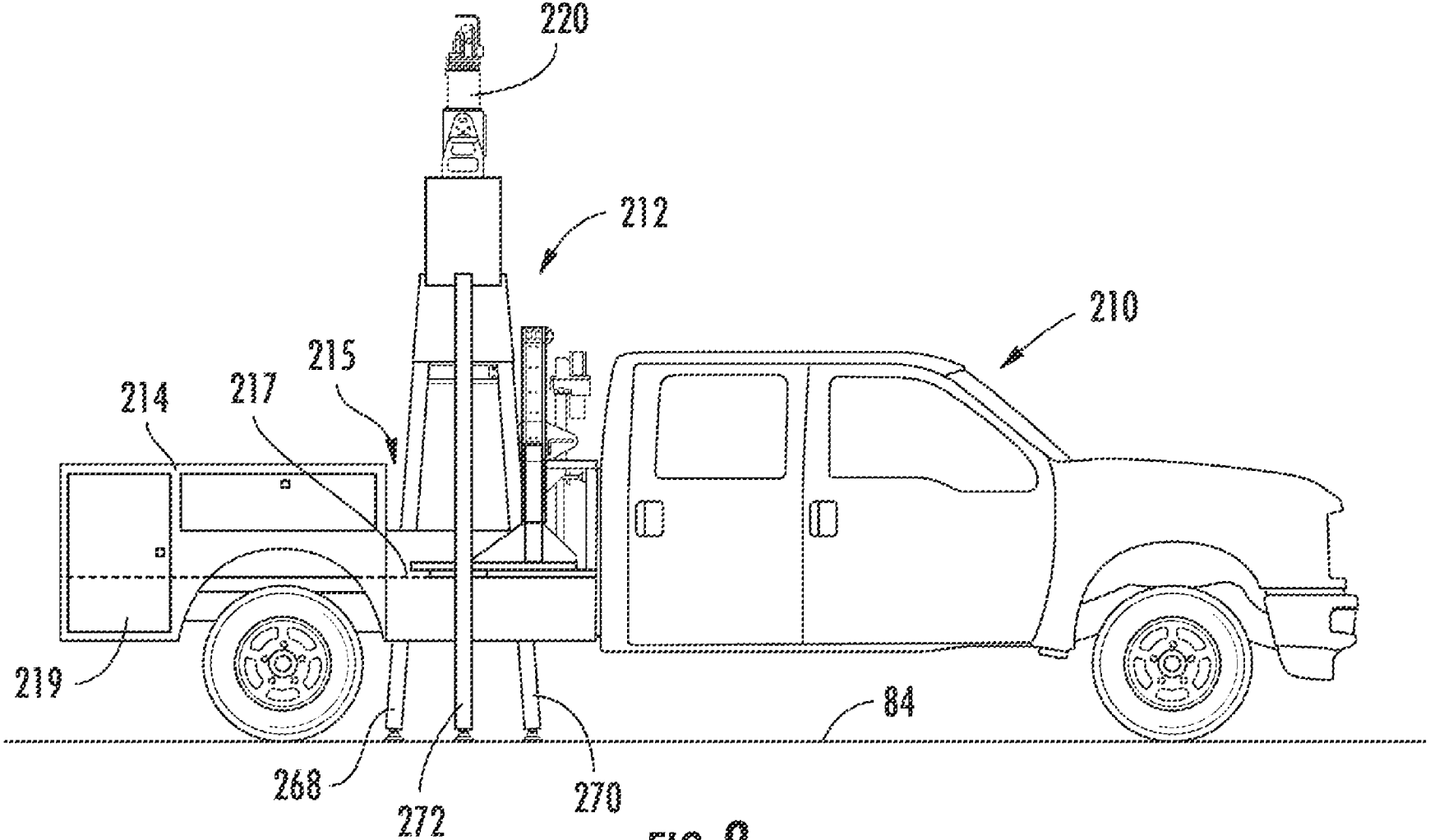
FIG. 8 is a side view of the vehicle and platform lift of FIG. 7 according to an exemplary embodiment.

Referring now to FIGS. 7 and 8, a vehicle 210 and platform lift 212 are shown according to an exemplary embodiment. Platform lift 212 may be substantially the same as platform lift 12, and may operate in a similar manner between a first position, as shown in FIG. 7, and a second position, as shown in FIG. 8. Vehicle 212 may be a truck having a customized rear portion or bed 214. For example, as shown in FIG. 8, bed 214 may include a recessed portion 215 having a support surface 217 configured to support platform lift 212. Recessed portion 215 may have a reduced width (e.g., from side-to-side of a vehicle) and/or height relative to the remainder of bed 14. For example, recessed portion may be a portion of vehicle 210 where the typical truck bed has been removed such that a platform lift may be coupled to a chassis or frame of the truck. In other embodiments, recessed portion 215 may be sized so as to permit legs 268, 270, 272 of platform lift 212 to remain within the periphery (e.g., the footprint, width, the side perimeter, etc.) of vehicle 210 (e.g., such that no components of platform lift 212 extend further outward in a horizontal direction than the outermost portions of vehicle 210). For example, as shown in FIG. 7, the outermost portions of legs 268, 270, 272 extend to a width that is substantially the same as the width of vehicle 210. In other embodiments, legs 268, 270, 272 may be substantially narrower than the width of vehicle 210.

According to some embodiments, bed 214 may further be provided with one or more storage compartments 219 (e.g., cabinets, shelving members, toolboxes, etc.) that form one or both sidewalls of bed 214. Storage compartments 219 may be configured to store one or more components of platform lift 212 when not in use (e.g., a device such as device 20). Other features may be provided as part of bed 14 according to various alternative embodiments. Further yet, the portion of bed 214 rearward of recessed portion 215 may be omitted in some embodiments. Other configurations of bed 214 are possible according to various other exemplary embodiments.

Figure 9:
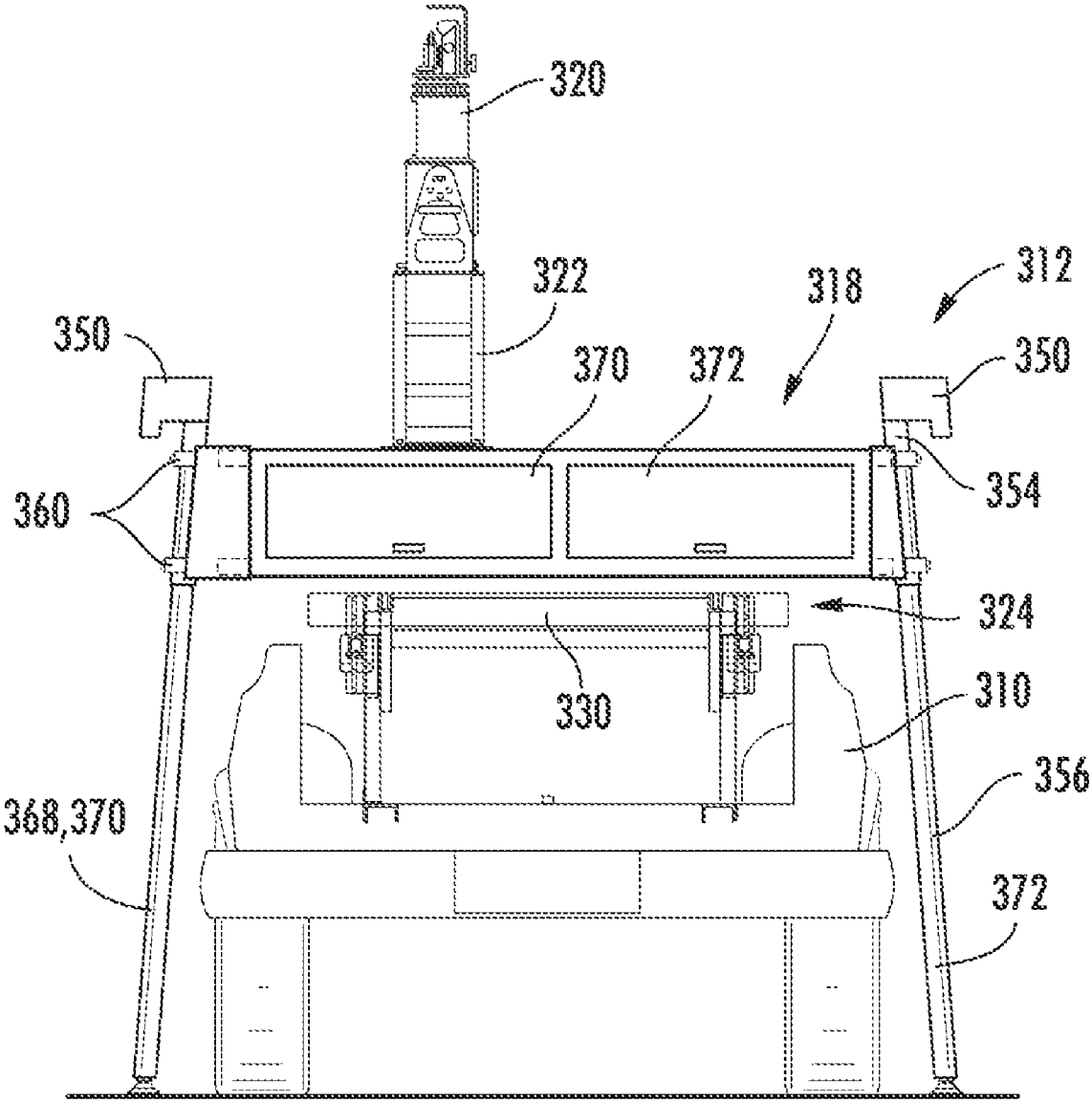
FIG. 9 is a rear view of a vehicle and platform lift according to another exemplary embodiment.

Referring now to FIG. 9, a vehicle 310 and platform lift 312 are shown according to an exemplary embodiment. As shown in FIG. 9, platform lift 312, and more specifically, a base 324, may be coupled to vehicle 310 in a similar manner to how platform lift 12 is coupled to vehicle 10. A support portion 330 may be provided and may be similar to support portion 30, except that in some embodiments, support portion 330 may be configured to remain in a fixed position (e.g., a fixed vertical position) as support structure 318 is moved between an upper position (e.g., as shown in FIG. 9), where support structure 318 is supported by legs 368, 370, 372, and a lower position (not shown), where support structure 318 is supported by support portion 330, and in turn, vehicle 310.

According to an exemplary embodiment, in order to move support structure 318 between a raised and lowered position (or to any of a number of different vertical positions), each of legs 368, 370, 372 is provided with an independent drive mechanism 350. For example, as shown in FIG. 9, drive mechanism 350 is coupled to a top portion of leg 372, and actuation of drive mechanism 350 may cause an upper leg portion or shaft 354 to move longitudinally with respect to a lower leg portion or shaft 356 in order to change the length of leg 372, and in turn, the position (e.g., vertical position) of support structure 318. Any suitable type of drive mechanism may be used, including motors/screw gears, hydraulic, pneumatic, or other types of mechanisms, etc. Further, while drive mechanisms 350 are shown coupled to the top of each of legs 368, 370, 372, in other embodiments, drive mechanism 350 may be provided at a bottom portion, a middle portion, or at any suitable location along the length of legs 368, 370, 372. In yet other embodiments, certain portions of drive mechanism 350 may be coupled to a component (e.g., vehicle 310) other than legs 368, 370, 372. Providing each leg 368, 370, 372 with a separate drive mechanism 350 may provide an advantage over other configurations in that each of the legs may be raised or lowered to accommodate uneven terrain such as irregular road surfaces, uneven construction terrain, etc. As with drive mechanism 50, drive mechanism 350 may be controlled remotely (e.g., via a wired, wireless, etc. connection) from a passenger compartment of vehicle 310.

Referring further to FIG. 9, one or more of legs 368, 370, 372 may be removeable via an interface 360 (e.g., a connector, joint, fastener, locking pin, etc.). Further, secondary support 322 and/or device 320 may be provided so as to be easily removeable from platform lift 312. Support structure 318 may include one or more storage compartments 370, 372 (e.g., drawers, cabinets, shelves, etc.), configured to store all or some of device 320, secondary support 322, and/or legs 368, 370, 372 when platform lift 312 is not in use (e.g., during travel to and/or from a worksite, during storage of platform lift 312, etc.). Storage compartments 370, 372 may be provided in any suitable size or shape, and more or fewer storage compartments may be provided than shown in FIG. 9. Further, storage compartments 370, 372 may be configured to store other items than those mentioned herein.

The platform lift shown and described herein may provide for a stable support structure that may be independent from a vehicle, or structurally or substantially independent (e.g., in the case of a cable between the vehicle and a scanner atop platform lift 12, etc.) while taking measurements, and moved between locations between measurements, all while being operated from within the vehicle. Such a system maintains the desired stability provided by more conventional systems (e.g., systems where personnel use externally-mounted stabilizers to raise an entire vehicle off of its own suspension system) without the need for the typically large and cumbersome equipment (e.g., stabilizers and lift systems capable of lifting the weight of an entire vehicle) and/or the need to purchase expensive customization kits that require vehicle customization to mount the stabilizers and/or associated devices.

It should be noted that the various exemplary embodiments and the features thereof may be utilized in combination with each other to suit particular applications. Furthermore, the various features shown in the FIGURES may be used alone or in combination with the various other exemplary embodiments disclosed herein. All such features and combinations of features are within the scope of the present disclosure.

It is important to note that the arrangement of the platform lift, as shown, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited herein. Accordingly, all such modifications are intended to be included within the scope of the present disclosure as described herein. The order or sequence of any process or method steps may be varied or re-sequenced according to alternative embodiments. Other substitutions, modifications, changes, and/or omissions may be made in the design, operating conditions and arrangement of the exemplary embodiments without departing from the scope of the present disclosure as expressed herein.

What is claimed is:

1. A platform lift for use with a vehicle, comprising:

a platform assembly comprising a plurality of elongated members and a projection extending transversely relative to the elongated members;

a plurality of support legs having fixed lengths and being fixedly coupled to the platform assembly such that the plurality of elongated members extend between the plurality of support legs;

a lift mechanism having a support portion moveable between at least a first position and a second position, the support portion comprising a pair of angled guide members angled away from each other and extending parallel to the elongated members of the platform assembly, the support portion further comprising at least one slot provided in one of the angled guide members;

wherein the platform assembly is configured to be supported by the support portion when the support portion is in the first position such that at least a portion of the platform assembly is received within and aligned with the angled guide members, and the projection is received within the slot to laterally align the platform assembly with the support portion; and wherein the platform assembly is configured to be supported by the support legs substantially independent from the lift mechanism and the vehicle when the support portion is in the second position.

2. The platform lift of claim 1, wherein the plurality of support legs consists of three support legs.

3. The platform lift of claim 1, wherein each of the plurality of support legs is a rigid support leg having a fixed length.

4. The platform lift of claim 1, wherein the platform assembly comprises a platform having a generally planar upper portion, and wherein the platform is supported by the plurality of support legs and structurally separate from the lift mechanism and the vehicle when the support portion is in the second position.

5. The platform lift of claim 4, wherein the plurality of support legs are secured to the platform in a non-moveable fashion.

6. The platform lift of claim 4, wherein the platform is configured to support a surveying device.

7. The platform lift of claim 1, wherein the lift mechanism is configured to be controlled from a passenger compartment of the vehicle.

8. The platform lift of claim 1, wherein the lift mechanism comprises a motor coupled to a screw gear.

9. A platform lift for use with a vehicle, comprising:

a platform assembly having a platform and a plurality of rigid support legs coupled to the platform, the platform being configured to support a surveying device so that the surveying device may be operated while supported by the platform, the platform comprising a plurality of elongated members extending between the plurality of rigid support legs and at least one projection extending transversely relative to the elongated members; and a lift mechanism configured to be coupled to the vehicle and having a platform support moveable between at least a first position and a second position, the platform support comprising a pair of guides, each guide comprising a bent portion, wherein the bent portions angle away from each other and are configured to facilitate engagement of the elongated members of the platform with the platform support, the platform support further comprising at least one slot provided in the bent portions;

wherein the platform is supported by the platform support when the platform support is in the first position such that at least a portion of the platform assembly is received within and aligned with the bent portions and the at least one projection is received within the at least one slot; and wherein the platform is supported by the plurality of rigid support legs and structurally separate from both the lift mechanism and the vehicle when the platform support is in the second position.

10. The platform lift of claim 9, wherein the surveying device and the lift mechanism are configured to be operable from a passenger compartment of the vehicle.

11. The platform lift of claim 9, wherein the platform assembly and the lift mechanism are configured to permit an operator to move the vehicle from a first location to a second location while the lift mechanism is in the first position.

12. The platform lift of claim 9, wherein the vehicle is a truck having a bed located at a rear portion of the truck, and the lift mechanism is configured to be positioned upon the bed of the truck.

13. The platform lift of claim 9, wherein the lift mechanism comprises a motor and a screw gear.

* * * * *